United States Patent [19]

Riedel

[11] 4,239,254

[45] * Dec. 16, 1980

[54] BINDING ACTUATED SKI BRAKE

[75] Inventor: Tilo Riedel, Eching, Fed. Rep. of Germany

[73] Assignee: Etablissements Francois Salomon & Fils, Annecy Haute-Savoie, France

[ * ] Notice: The portion of the term of this patent subsequent to Feb. 6, 1996, has been disclaimed.

[21] Appl. No.: 906,129

[22] Filed: May 15, 1978

Related U.S. Application Data

[63] Continuation-in-part of Ser. No. 707,453, Jul. 21, 1976, abandoned.

[30] Foreign Application Priority Data

Jul. 22, 1975 [DE] Fed. Rep. of Germany ..... 2532736

[51] Int. Cl.[3] ..... A63C 7/10

[52] U.S. Cl. ..... 280/605

[58] Field of Search ..... 280/605, 604; 188/5

[56] References Cited

U.S. PATENT DOCUMENTS

| | | | |
|---|---|---|---|
| 3,909,024 | 9/1975 | Salomon | 280/605 |
| 3,992,030 | 11/1976 | Salomon | 280/605 |
| 4,138,136 | 2/1979 | Riedel | 280/605 |

FOREIGN PATENT DOCUMENTS

| | | | |
|---|---|---|---|
| 2501403 | 7/1975 | Fed. Rep. of Germany | 280/605 |
| 2628374 | 6/1977 | Fed. Rep. of Germany | 280/605 |
| 2255926 | 7/1975 | France | 280/605 |
| 2278363 | 2/1976 | France | 280/605 |
| 349911 | 12/1960 | Switzerland | 280/605 |

*Primary Examiner*—David M. Mitchell
*Attorney, Agent, or Firm*—Karl F. Ross

[57] ABSTRACT

A ski has a heel or toe clamp which is displaceable between a down position holding a skiboot on the ski and an up position freeing the skiboot from the ski. An elongated brake element is pivoted on the ski for movement between a rest position parallel to the ski and a braking position transverse to the ski and extending downwardly below the bottom surface thereof. This element carries a lateral projection which engages in a laterally open recess formed on the clamp or in a rail carried on the clamp so that as the clamp pivots into the up position it pivots the brake element into the braking position. The recess may have a laterally inclined camming surface that further swings the brake element from a position overlying the upper surface of the ski into a position spaced laterally from the ski on displacement of the element from the braking to the rest position.

7 Claims, 5 Drawing Figures

BINDING ACTUATED SKI BRAKE

CROSS-REFERENCE TO RELATED APPLICATION

This application is a continuation-in-part of my copending and commonly owned application Ser. No. 707,453 filed July 21, 1976 and now abandoned.

FIELD OF THE INVENTION

The present invention relates to a ski brake in general, and more particularly to a ski brake having an elongated brake element.

BACKGROUND OF THE INVENTION

There are already known various types of ski brakes of different constructions which, generally speaking, include at least one brake element mounted on the ski for displacement between a retracted position in which the brake element does not interfere with the free movement of the ski over the surface of the ski slope or the like, and an extended position in which the brake element projects underneath the ski to engage the snow or in surface on which the ski may travel after becoming detached from the skiboot. The provision of such a ski brake is a very necessary and advantageous expedient, especially since the detached and uncontrolled ski may otherwise gain a substantial speed and wreak havoc among the other skiers and possibly result in injury to skiers who cannot avoid collision with such an uncontrolled ski.

The conventional ski brakes, some of which already use elongated brake elements, work quite satisfactorily and have gained widespread acceptance. However, such ski brakes have an important disadvantage in that they are constructed and mounted on the ski as separate additional accessory, which results in unnecessary material and labor expenditure. Also, since the ski brake is to be moved into its retracted, that is, inoperative position prior to or simultaneously with the attachment of the skiboot to the ski, this represents either an additional operation preparatory to the use of the ski, or an additional point which has to be watched during the attachment of the skiboot to the ski, in addition to the one or more movable components of the safety binding, in order to properly position the skiboot relative to these parts and to properly align and actuate all such parts.

Prior-art ski brakes can be seen in U.S. Pat. Nos. 3,909,024 and 3,992,030, as well as in French Pat. Nos. 2,255,926 and 2,278,363 and in Swiss Pat. No. 349,911, and in German patent publications Nos. 2,501,403 and 2,628,374.

OBJECTS OF THE INVENTION

It is therefore an object of the present invention to improve on the principles set forth in the above-identified copending application.

Another object is the provision of an improved ski brake.

A general object of the present invention is to avoid the above-mentioned disadvantages of the prior art.

More particularly, it is an object of the present invention to provide a ski brake which is not possessed of the disadvantages of the prior-art ski brake.

A further object of the present invention is to provide a ski brake which is simple in construction and reliable in operation.

Yet another object of the present invention is to provide a ski brake the displacement of which between the retracted and the extended position can be solely controlled by the movement of a movable component of the safety binding.

It is a concomitant object of the present invention so to construct the ski brake that it will become active immediately upon detachment of the skiboot from the safety binding of the ski.

SUMMARY OF THE INVENTION

In pursuance of these objects and others which will become apparent hereafter, one feature of the present invention resides in a ski having one component and equipped with a safety binding which has another component that is movable toward and away from the one component to attach a skiboot to and detach same from the ski and a ski brake which includes an elongated brake element. Means is provided for mounting one portion of the brake element on the one component and means is provided for mounting another portion of the brake element on the other component, wherein one of the mounting means mounts the respective portion on the respective component for pivoting relative thereto, and the other mounting means mounts the associated portion of the brake element on the associated component for pivoting and for displacement in a predetermined path relative thereto. In this manner the movement of the one component toward the other component results in pivoting of the brake element about the above-mentioned one mounting means from an operative extended position to an inoperative retracted position. The one component may be mounted on the ski for pivoting relative thereto, and the other mounting means may so mount the associated portion on the associated component that pivoting of the other component away from the one component results in pivoting of the brake element about the above-mentioned one mounting means from the retracted to the extended position.

In this manner the ski brake is always actuated in dependence on the movement of the movable component of the safety binding so that when the skiboot is attached to the ski, the ski brake is in its retracted position in which it does not interfere with the free movement of the ski over the surface of the snow on the ski slope or the like. On the other hand, when the skiboot has become detached from the safety binding, such as when the safety binding releases the skiboot upon a fall of the skier, the ski brake will immediately move to its operative extended position and retard and eventually stop the movement of the ski without control over the ski slope.

The movable component of the safety binding may be, for instance, a heel clamp which is mounted on the ski for pivotal displacement. However, this component may be any other part of the heel clamping arrangement or, for that matter, any other movable component of the safety binding, such as a front jaw.

An important advantage of the ski brake of the present invention which is combined with and/or operated by the movable component of the ski binding is to be seen in the fact that the skier need no longer concentrate on several points at the same time so as to assure proper positioning of the skiboot in the front jaws, the proper positioning of the skiboot relative to the ski brake, and the simultaneous proper positioning of the rear part of the skiboot relative to the heel clamping arrangement. A further important advantage is that the mounting of the ski brake on the ski is substantially simplified and facilitated since the ski brake can be mounted on the ski together with the safety binding of which it may form a constituent part, being, for instance, connected thereto at the factory at the time of assembly of the safety binding. In this manner, the separate and possibly complex operation of mounting the ski brake separately on the ski is avoided, which is of a considerable practical importance particularly where the mounting of the safety binding on the ski may interfere with the mounting of the ski brake on the ski, or vice versa.

According to a currently preferred aspect of the present invention, the one component is a part of the safety binding that is fixed to the ski. In this event, the ski brake can be assembled with the safety binding at the manufacturing plant, as mentioned above. Furthermore, the one mounting means may include a pivot which connects the respective portion of the brake element to the respective component, and the mounting means may include an elongated guide recess at the associated component, and a projection on the associated portion of the brake element which is received in the guiding recess for displacement longitudinally thereof. However, it is also conceivable and contemplated by the present invention that the guide recess could be provided on the associated portion of the brake element and the projection could be a part of the associated component, which would only result in a kinematic reversal of the parts without changing the function thereof.

According to a further aspect of the present invention, the other mounting means may include a separate rail having the guide recess and connected to the associated component or the associated portion of the brake element. The rail may have, for instance, a U-section, or it may have a generally C-section and the projection may extend into the interior of the C-section rail. The other mounting means may further comprise at least one sliding element which is mounted on the projection and engages the surfaces that bound the elongated recess. Preferably, the sliding element may be a roller which is mounted on the projection for rotation.

The above-mentioned guiding recess may have a cam surface which contacts and cooperates with the projection of the brake element, and the cam surface may have at least a surface portion which is inclined laterally of the ski so that the brake element is displaced transversely of the ski when the projection cooperates with the surface portion, such as during the terminal part of movement of the movable component toward the ski. In this event, the one mounting means may also mount the respective portion of the brake element on the respective component for pivoting displacement transversely of the ski about an upright axis so as to bring the brake element from a position laterally of the ski to a position above the upper surface of the ski.

Instead of the above-mentioned rail-and-projection arrangement, the other mounting means may include a different cam follower arrangement, an eccentric arrangement or a kinematic linkage arrangement. Also, the other component, that is the movable component, may be connected to a further component of the safety binding for partial pivoting therewith.

SPECIFIC DESCRIPTION

Figure 1:
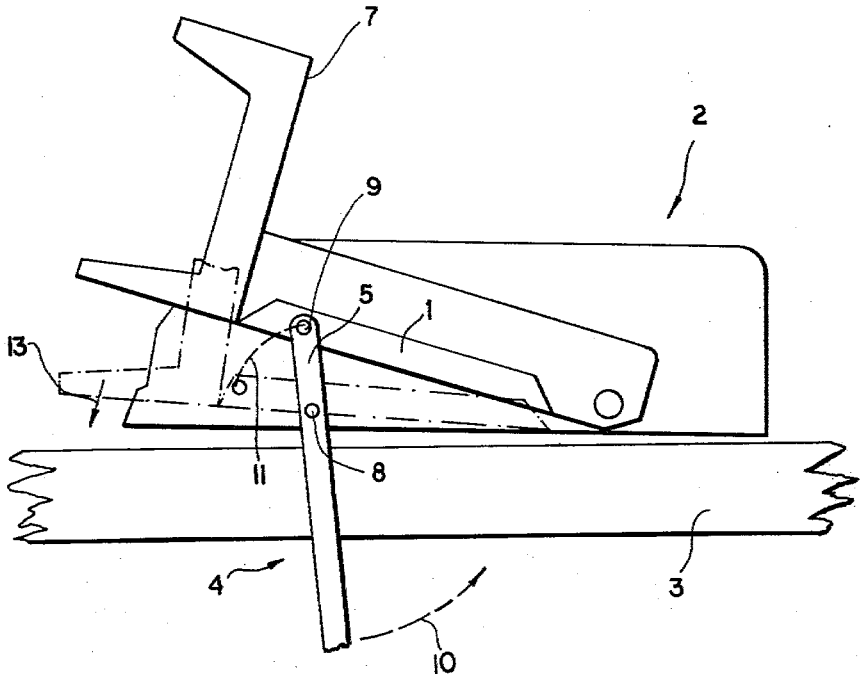
FIG. 1 is a somewhat schematic view of the ski brake of the present invention and a portion of the ski and of the safety binding.

FIG. 1 shows a safety binding 2 which is mounted on a ski 3 and includes a movable component 7, in the illustrated embodiment a heel clamp which is pivotally mounted on the ski 3 for movement toward and away from the upper surface of the ski 3. The heel clamp 7 or a similar movable part of the safety binding is formed with a recess 1 either directly therein or in a separate rail which is rigidly connected to the heel clamp 7. The recess 1 is elongated and a projection 9 mounted on one end portion 5 of a brake element 4 is received and guided in the recess 1 during the upward or downward movement of the heel clamp 7 relative to the ski 3. A flexible spring steel pivot 8 mounts the brake element 4 on an immovable component, such as an immovable component of the safety binding or the ski 3 itself or a bracket mounted on the ski 3, so that the braking element 4 can pivot about the pivot 8, whereby the projection 9 conducts the movement indicated by the arrow 11, while the free end portion of the brake element conducts movement indicated by the arrow 10. This pivot is flexible to allow the element 4 to pivot on ski 3 about a horizonal axis parallel to the upper surface of the ski and perpendicular to the normal direction of travel thereof, and about an upright axis perpendicular to the upper surface of the ski and to the travel direction.

When the heel clamp 7 is displaced downwardly that is when the not-illustrated skiboot is being fitted into the safety binding, the projection 9 slides in the recess 1 so that the elongated brake element 4 will pivot, in the directions of the arrows 10 and 11, from the illustrated extended position into a retracted position in which the brake element will extend substantially parallel to the upper surface of the ski 3 laterally thereof or even above the same as will be discussed later on.

Figures 2, 3, 4:
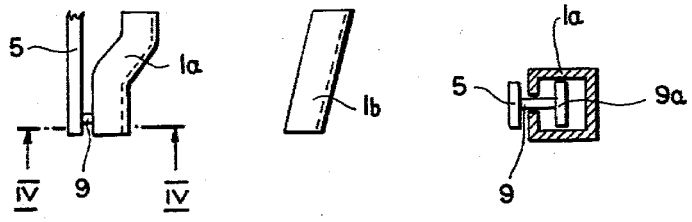
FIG. 2 illustrates in top view a portion of a rail which may be used in the arrangement of FIG. 1.
FIG. 3 illustrates in top view a portion of a different rail which may be used instead of that of FIG. 2.
FIG. 4 is a section taken along line IV—IV of FIG. 2.

The above given relationship of parts may be easily reversed, that is, the recess 1 can be provided in a stationary component of the safety binding or in a separate rail connected to such a stationary component or to the ski itself, in which event the lever-shaped brake element would be only pivoted at 9 and received in the recess 1 for pivoting and displacement in a given path at 8. Also, it is conceivable and contemplated by the present invention to provide the recess 1, which may then have the configuration of a slot, in the brake element 4, in which event one of the members 8 and 9 would be a pivot and the other would be a projection received in the recess 1 of the brake element 4. The slidable one of the members 8, 9 can be equipped with friction-reducing sliding elements, such as rollers. As already mentioned in the above discussion and as shown in FIGS. 2 and 3, the recess can be provided in a separate rail connected to the respective one of the components. The rail may be of a generally U-shaped cross section, being open toward the end portion 5 of the brake element 4 or toward the projection 9 thereof. On the other hand, the rail may be a circumferentially incomplete multiside hollow profile, such as one resembling the letter C, and the end portion 5 of the brake element 4 or the projection 9 thereof can extend into the interior of such profile. In such an arrangement the pivot 8 is relatively loose and the projection 9 has an enlarged head 9*a* guided in the rail 1*a* for lateral swinging of the element 4 about an axis perpendicular to the upper surface of the ski when displaced into the rest position.

It will be seen that, upon proper selection of the distance between the members 9 and 8 and of the length of the end portion 6 of the lever-shaped elongated brake element 4, as well as upon proper selection of the location and length of the recess 1, the brake element 4 will be capable of performing any desired pivoting movement between its illustrated extended position and the dashed-line retracted position in response to the pivoting of the heel clamp 7 relative to the ski 3 toward or away from the latter. Depending on the location of the members 8 and 9 and the recess 1, the brake element 4 can move either in the forward direction of the ski or in the rearward direction of the ski as far as the free end portion 6 of the brake element 4 is concerned, depending on the available space and similar considerations.

The guide recess 1 is bounded by a cam surface which contacts and cooperates with the projections 9. Whether the recess 1 is provided directly in the component 7 or in a separate rail, at least a portion of the cam surface of the guide recess 1 may be inclined in the lateral direction of the ski 3. When the recess is provided in a rail, the rail may have an end portion 1*a* or 1*b*, as illustrated in FIG. 2 and in FIG. 3, respectively, such end portion being either arcuate as illustrated in FIG. 2 or inclined as illustrated in FIG. 3. Inasmuch as the projection 9 follows the cam surface of the recess 1, the inclined surface portion of the cam surface which is so situated as to cooperate with the projection 9 during the terminal part of the movement of the heel clamp 7 toward the ski 3, pivots the brake element 4 transversely of the ski 3 from a position laterally of the ski 3 to a position above the upper surface of the ski 3 so as to eliminate any possiblity of interference of the brake element 4 with the operation of the ski 3 when the skiboot is lodged in the safety binding.

Figure 5:
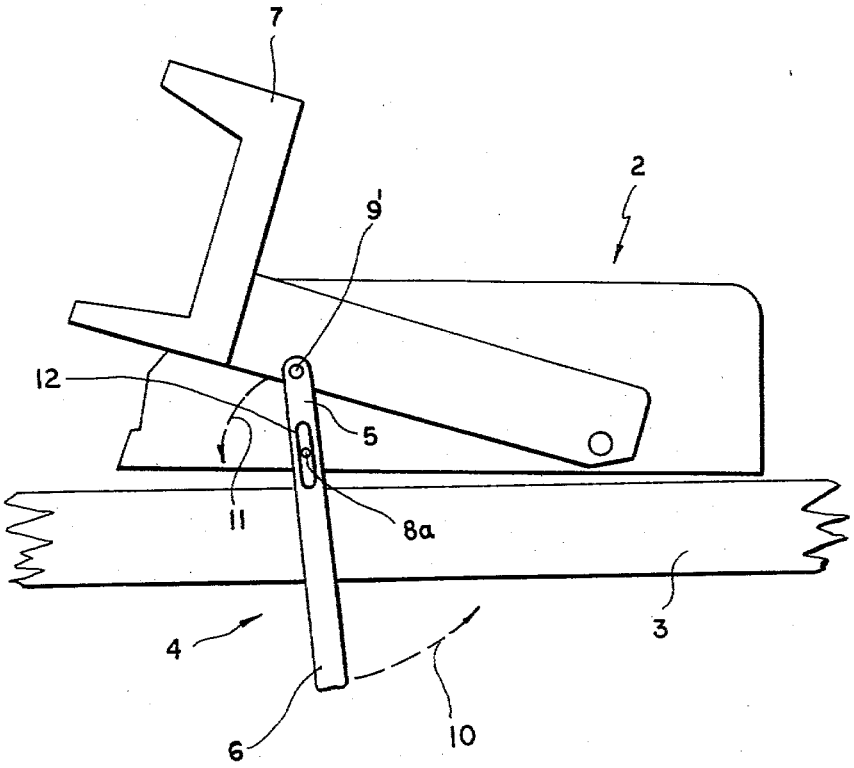
FIG. 5 is a view similar to FIG. 1 illustrating another ski brake according to this invention.

FIG. 5 shows an arrangement wherein the element 6 is formed with a longitudinal slot 12 in which a pivot pin 8*a* fixed on the clamp 2 is received. Furthermore in this arrangement the pivot 9' is fixed on the heel clamp 7 for sliding of the pin 8*a* in the slot 12 during displacement of the heel clamp 7 into the down position.

It will be understood that each of the elements described above, or two or more together, may also find a useful application in other types of constructions differing from the types described above. So, for instance, instead of using the above-discussed recess-and-projection arrangement for the other mounting means, any other cam and follower arrangement could be used, or an eccentric arrangement, or a kinematic linkage arrangement. Also, the lever-shaped brake element 4 need not be necessarily actuated by the heel clamp 7, but could be rather actuated by any other movable component of the ski binding, such as the front jaw or another component of the binding which is connected to the heel clamp 7 for partial pivoting therewith.

I claim:

1. In combination:

an elongated ski having an upper surface and constituting a first component;

clamp means on said ski constituting a second component and movable toward and away from said ski about a clamp axis transverse to said ski and generally parallel to said surface for securing a skiboot to and freeing same from said ski;

an elongated brake element having a lateral projection;

means defining between said brake element and one of said components a first pivot spaced from said projection for pivoting of said brake element about an element axis transverse to said ski and generally parallel to said surface on said one component and displacement of said projection relative to said one component and a second pivot for pivoting of said brake element about an upright axis transverse to said ski and to said surface relative to said one component;

guide means on the other of said components and having on said other component a recess receiving said projection for pivoting of said brake element from a rest position generally parallel to said ski to a braking position generally transverse to said ski on displacement of said clamp means from a down position relatively close to said ski to an up position relative far from said ski; and means in said recess including a laterally offset cam portion for laterally swinging said element about said upright axis transverse to said ski and to said surface into a position at least partially overlying said surface.

2. The combination defined in claim 1 wherein said one component on which said brake element is pivoted is said ski and said other component is said clamp means.

3. The combination defined in claim 1 wherein said one component on which said brake element is pivoted is said clamp means and said other component is said ski.

4. The combination defined in claim 1 wherein said clamp means is elongated transverse to said clamp axis and said recess is elongated longitudinal direction of said clamp means.

5. The combination defined in claim 1 wherein said projection is slidable in said recess.

6. In combination:

an elongated ski having an upper surface and constituting a first component;

clamp means on said ski constituting a second component and movable toward and away from said ski about a clamp axis transverse to said ski and generally parallel to said surface for securing a skiboot to and freeing same from said ski;

an elongated brake element having a laterl projection;

means defining between said brake element and one of said components a first pivot spaced from said projection for pivoting of said brake element about an element axis transverse to said ski and generally parallel to said surface on said one component and displacement of said projection relative to said one component and a second pivot for pivoting of said brake element about an upright axis transverse to said ski and to said surface relative to said one component; and guide means on the other of said components and having a recess receiving said projection for pivoting of said brake element from a rest position generally parallel to said ski to a braking position generally transverse to said ski on displacement of said clamp means from a down position relatively close to said ski to an up position relatively far from said ski and for pivoting of said brake element laterally about said upright axis when in said rest position from a position adjacent said ski to a position at least partially overlying said surface.

7. In combination:

an elongated ski having an upper surface and constituting a first component;

clamp means on said ski constituting a second component and movable toward and away from said ski about a clamp axis transverse to said ski and generally parallel to said surface for securing a skiboot to and freeing same from said ski;

an elongated brake element having a lateral projection;

means defining between said brake element and one of said components a pivot spaced from said projection for pivoting of said brake element about an element axis transverse to said ski and generally parallel to said surface on said one component and displacement of said projection relative to said one component; and means including a U-section rail on the other of said components and having a laterally open recess receiving said projection for pivoting of said brake element from a rest position generally parallel to said ski to a braking position generally transverse to said ski on displacement of said clamp means from a down position relatively close to said ski to an up position relatively far from said ski.

* * * * *